US008801144B2

(12) United States Patent
Tsuji

(10) Patent No.: US 8,801,144 B2
(45) Date of Patent: Aug. 12, 2014

(54) INKJET RECORDING DEVICE

(75) Inventor: Kikunosuke Tsuji, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 502 days.

(21) Appl. No.: 12/781,692

(22) Filed: May 17, 2010

(65) Prior Publication Data

US 2010/0295895 A1 Nov. 25, 2010

(30) Foreign Application Priority Data

May 19, 2009 (JP) ..... 2009-120766

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 5,670,996 | A * | 9/1997 | Mitani | 347/29 |
| 2008/0106571 | A1 * | 5/2008 | Izawa et al. | 347/33 |
| 2008/0278537 | A1 | 11/2008 | Watanabe | |

FOREIGN PATENT DOCUMENTS

| | | | |
|---|---|---|---|
| JP | H07-266570 | A | 10/1995 |
| JP | H09-220813 | | 8/1997 |
| JP | 2001-171137 | A | 6/2001 |
| JP | 2005-335303 | A | 12/2005 |
| JP | 2006-305772 | A | 11/2006 |
| JP | 2007-216496 | | 8/2007 |
| JP | 2007-253591 | A | 10/2007 |
| JP | 2008-290313 | A | 12/2008 |

OTHER PUBLICATIONS

Notice of Reasons for Rejection issued to JP Application No. 2009-120766 mailed Dec. 4, 2012.

* cited by examiner

*Primary Examiner* — Alejandro Valencia
(74) *Attorney, Agent, or Firm* — Knobbe Martens Olson & Bear LLP

(57) ABSTRACT

An inkjet recording device is provided, which includes a recording head, a cleaning unit and a wiper cap member. The recording head includes a nozzle face on which an ink-injecting nozzle is formed. The cleaning unit includes a wiper case and a wiper member. The wiper case has a wiper accommodating portion and a wiper opening. The wiper member is configured to be accommodated in the wiper accommodating portion, protrude out of the wiper accommodating portion via the wiper opening and move relatively to the recording head to clean the recording head. The wiper cap member shuts the wiper opening of the wiper case.

8 Claims, 19 Drawing Sheets

INKJET RECORDING DEVICE

This application is based on and claims the benefit of priority from Japanese Patent Application No. 2009-120766, filed on 19 May 2009, the content of which is incorporated herein by reference.

BACKGROUND OF THE INVENTION

1. Field of the Invention

The present invention relates to an inkjet recording device that performs recording on a recording medium such as paper by injecting ink from a nozzle.

2. Related Art

A recording head in an inkjet recording device has a nozzle face on which a plurality of nozzles for injecting ink is formed. The nozzle face requires cleaning in order to prevent a situation in which ink injection cannot be performed or an ink injection direction is changed due to foreign matter such as ink or dust adhered to the vicinity of the nozzle.

Regarding the cleaning of the nozzle face, a technique is known in which the nozzle face is cleaned (wiped) by way of a wiper member to remove ink adhered to the nozzle face. According to this technique, the ink is still adhered to the wiper member after cleaning the nozzle face. When the wiper member is left with the adhered ink, the ink thickens (viscosity increases). When the nozzle face is cleaned again by the wiper member to which the thickened ink is adhered, the thickened ink adhered to the wiper member adheres to the recording head, and it is likely to cause defective injection of ink.

In order to prevent such a defect due to the thickening of ink as describe above, it is generally practiced that ink adhered to a wiper member is removed.

However, it is difficult to completely remove the ink from the wiper member. As a result, a small amount of the ink remains in a film state on the wiper member, and the small amount of the remaining ink further thickens and dries. Due to the recurrence of such thickening and drying of the ink, the wiper member suffers from the adhesion of a large amount of the thickened and dried ink. Such a condition may eventually have a harmful effect on the recording head when cleaning the nozzle face of the recording head.

Accordingly, there is a technique to remove thickened ink from a recording head by way of ink absorbent attached to the recording head.

However, since an amount to be absorbed by the ink absorbent is limited, the effectiveness to remove thickened ink from the recording head is likely to disappear in this technique when the ink absorbent is repeatedly used.

SUMMARY OF THE INVENTION

Therefore, it is an object of the present invention to provide an inkjet recording device, in which thickening of ink adhered to a wiper member can be suppressed, and defective injection of ink is unlikely to occur even if a nozzle face of a recording head is cleaned by using the wiper member to which ink is adhered.

The present invention relates to an inkjet recording device, which includes a recording head, a cleaning unit and a wiper cap member. The recording head includes a nozzle face on which an ink-injecting nozzle is formed. The cleaning unit includes a wiper case and a wiper member. The wiper case has a wiper accommodating portion and a wiper opening. The wiper member is configured to be accommodated in the wiper accommodating portion, protrude out of the wiper accommodating portion via the wiper opening and move relatively to the recording head to clean the recording head. The wiper cap member shuts the wiper opening of the wiper case.

Moreover, it may be preferable that the wiper cap member shuts the wiper opening during the cleaning unit not cleaning the recording head.

In addition, it may be preferable that the cleaning unit includes a biasing member that biases the wiper member to pivot toward the wiper opening, and the wiper member is configured to pivot in a direction away from the wiper opening by being depressed by way of the wiper cap member while the wiper cap member is shutting the wiper opening.

Furthermore, it may be preferable that a depression slope is provided on an inner side of the wiper cap member. The depression slope slants toward a plane orthogonal to a direction associated with the wiper cap member approaching the wiper opening and depresses the wiper member while the wiper cap member is shutting the wiper opening.

Moreover, it is preferable that the cleaning unit includes an axle member and a wiper pivoting drive mechanism. The axle member is connected to the wiper member and pivotally supported by the wiper case. One end of the axle member protrudes out from an external surface of the wiper case. The wiper pivoting drive mechanism applies a driving force to the one end of the axle member so as to pivot the wiper member in a forward direction and a backward direction.

In addition, it is preferable that the wiper member is configured to be switchable between a state of being accommodated in the wiper accommodating portion and a state of standing erect to protrude out of the wiper accommodating portion via the wiper opening, while driven by the wiper pivoting drive mechanism pivoting the wiper member in the forward direction and the backward direction.

Furthermore, it is preferable that the inkjet recording device further includes a conveying unit and a nozzle cap member. The conveying unit faces the nozzle face of the recording head and has a conveying surface that can relatively approach and depart away from the nozzle face. The conveying unit conveys a recording medium positioned on the conveying surface. The nozzle cap member covers the nozzle face of the recording head. The cleaning unit is configured to be movable in a first direction in a separated state in which the conveying surface is apart from the nozzle face and disposed in a conveying space between the nozzle face and the conveying surface. The nozzle cap member is configured to be movable in a second direction opposite to the first direction towards the conveying surface in the separated state and disposed in the conveying space.

According to the present invention, it is possible to provide an inkjet recording device, in which thickening of ink adhered to a wiper member can be suppressed, and defective injection of ink is unlikely to occur even if a nozzle face of a recording head is cleaned by using the wiper member to which ink has been adhered.

DETAILED DESCRIPTION OF THE INVENTION

First Embodiment

Embodiments of the present invention will be described hereinafter with reference to the drawings.

Figure 1:
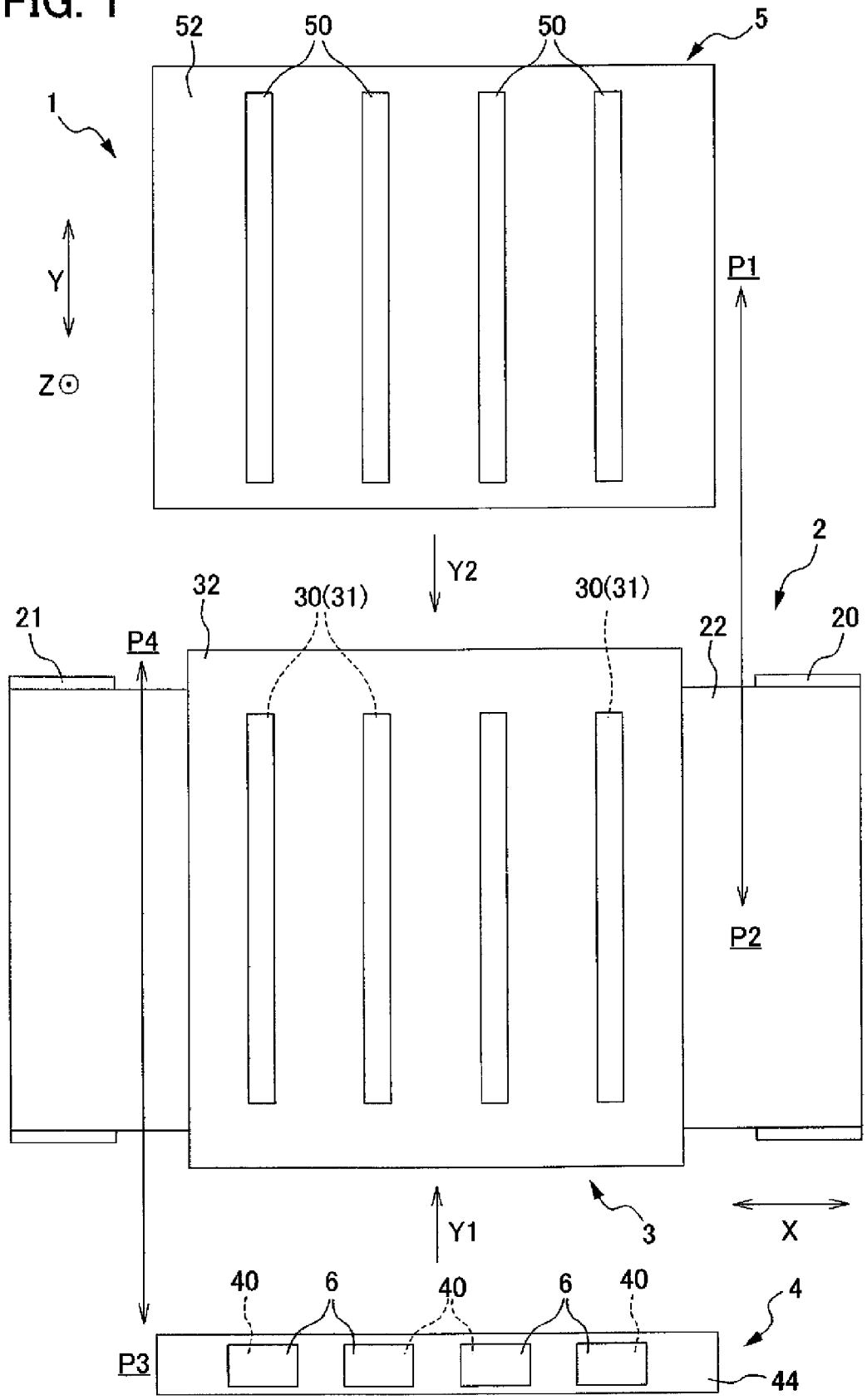
FIG. 1 is a plan view schematically showing an overview of an inkjet recording device 1 of a first embodiment.
Figure 2:
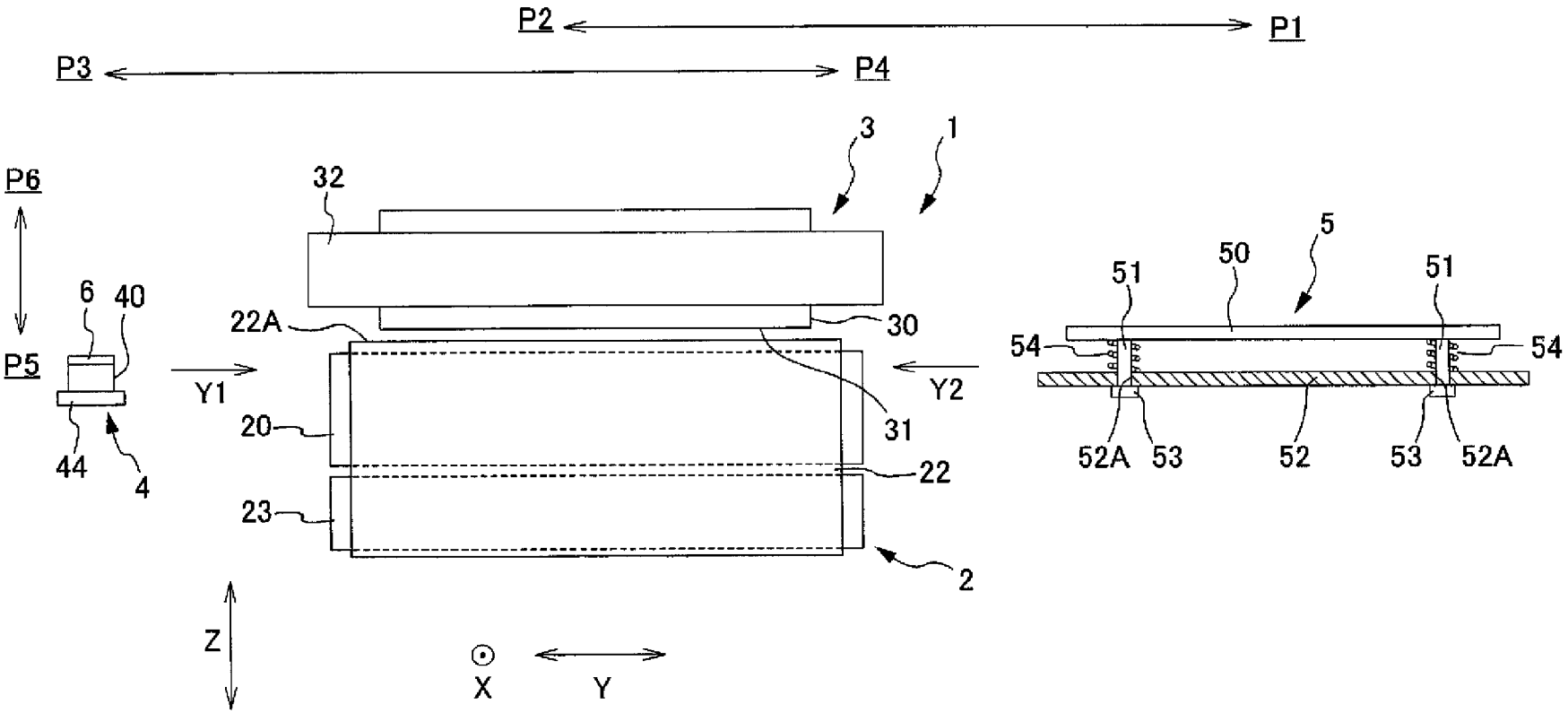
FIG. 2 is a right side view schematically showing an overview of the inkjet recording device 1 of the first embodiment.
Figure 3:
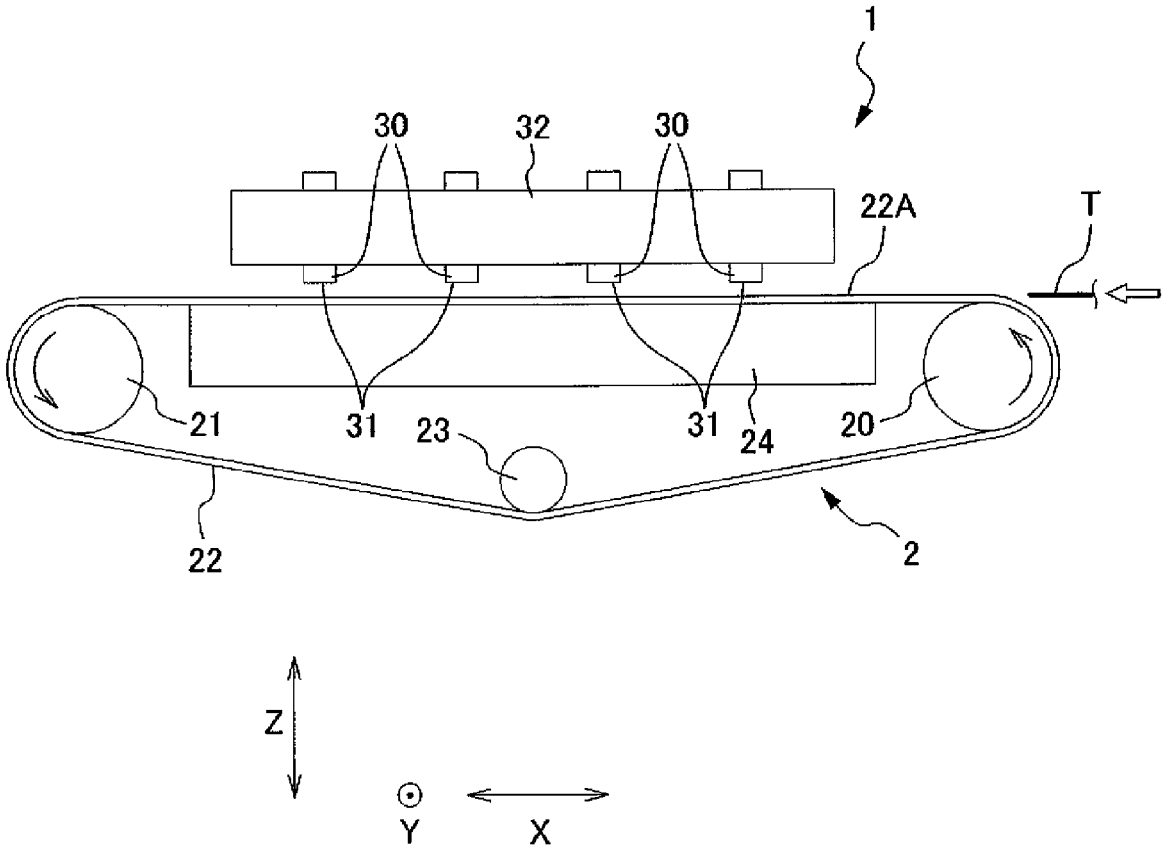
FIG. 3 is a front view schematically showing an overview of recording with the inkjet recording device 1 of the first embodiment.
Figure 4A:
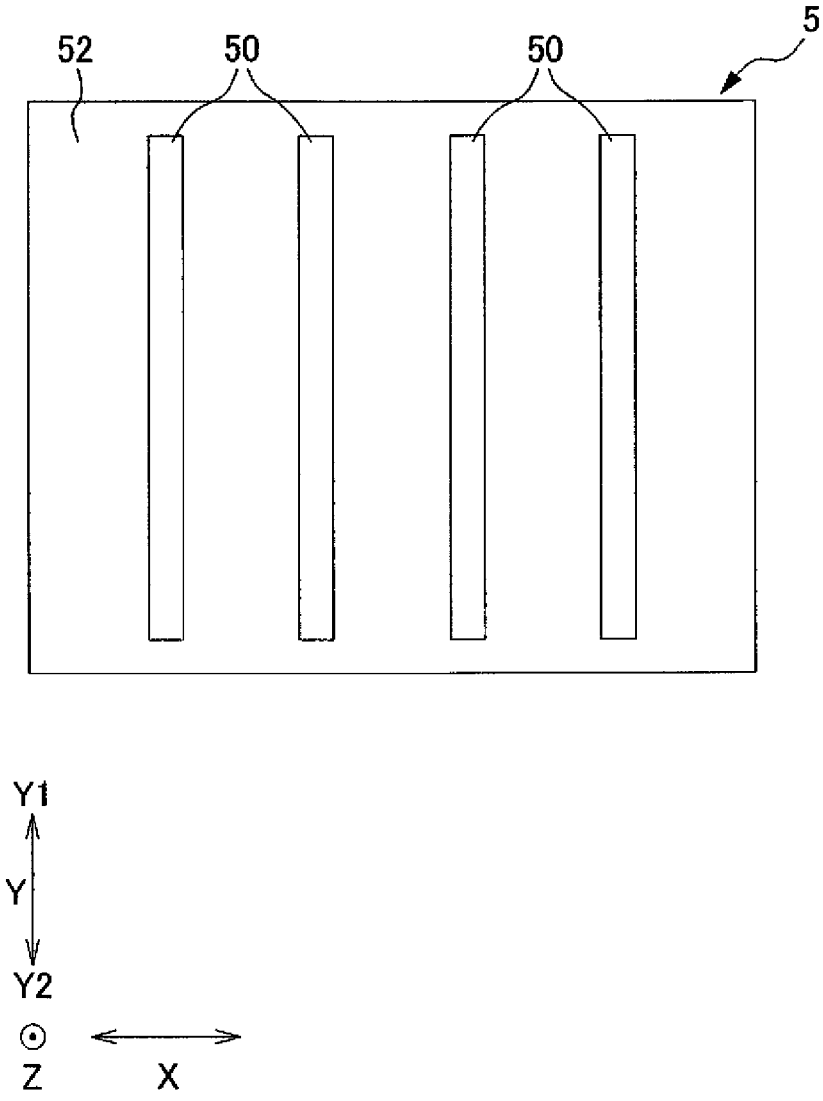
FIG. 4A is a plan view showing a cap unit 5 in the first embodiment.
Figure 4B:
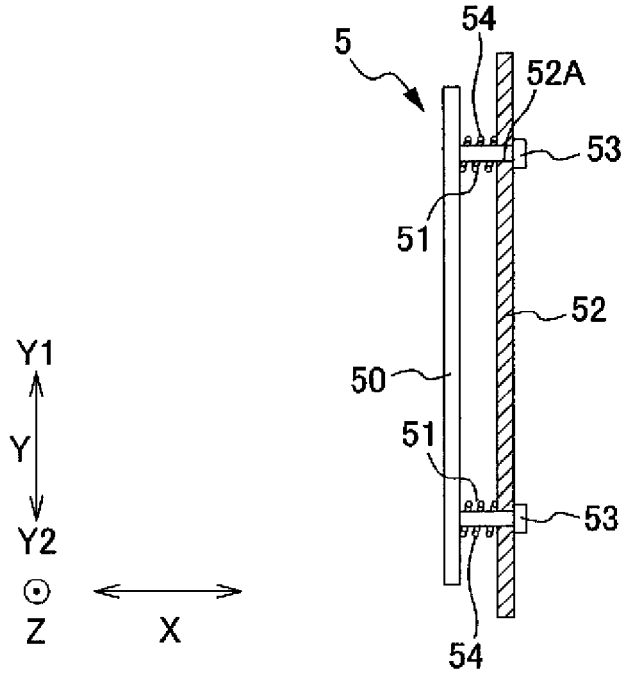
FIG. 4B is a right side view showing the cap unit 5 in the first embodiment.
Figure 4C:
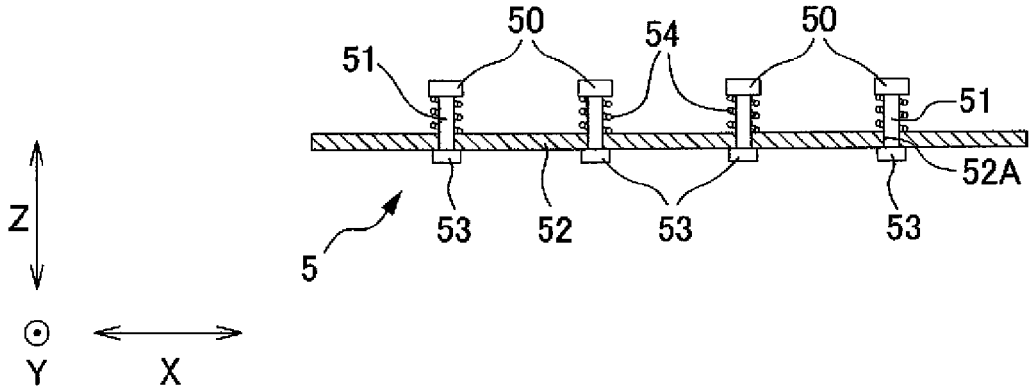
FIG. 4C is a front view showing the cap unit 5 in the first embodiment.

An overview of the entire structure of an inkjet recording device 1 of a first embodiment of the present invention is described with reference to FIGS. 1 to 4C. FIG. 1 is a plan view schematically showing an overview of the inkjet recording device 1 of the first embodiment. FIG. 2 is a right side view schematically showing an overview of the inkjet recording device 1 of the first embodiment. FIG. 3 is a front view schematically showing an overview of recording with the inkjet recording device 1 of the first embodiment. FIG. 4A is a plan view showing a cap unit 5 in the first embodiment. FIG. 4B is a right side view showing the cap unit 5 in the first embodiment. FIG. 4C is a front view showing the cap unit 5 in the first embodiment.

As shown in FIGS. 1 to 3, the inkjet recording device 1 includes a conveying unit 2, a nozzle unit 3, a cleaning unit 4, a cap unit 5, and wiper cap members 6.

As shown in FIGS. 1 to 3, the conveying unit 2 has a drive roller 20, a driven roller 21, a conveying belt 22 that bridges the drive roller 20 and the driven roller 21, a tension roller 23 adjusting tension of the conveying belt 22, and a suction unit 24. A multitude of through-holes for suction (not shown) is provided in the conveying belt 22. A top surface portion of the conveying belt 22 forms a conveying surface 22A. The conveying surface 22A of the conveying belt 22 is moved horizontally by the drive roller 20 from one side to the other in an X-direction in a horizontal plane. It should be noted that the X-direction is also referred to as a "conveying direction X." The suction unit 24 is disposed underneath (on an opposite side of) the conveying surface 22A of the conveying belt 22.

In addition, as shown in FIG. 3, when performing predetermined recording, a recording sheet T as a recording medium is introduced onto the conveying surface 22A of the conveying belt 22 from one side of the conveying direction X. With the operation of the suction unit 24, a suction force acting on the conveying belt 22 via the through-holes for suction (not shown) occurs in the conveying surface 22A. The recording sheet T, which has been introduced onto the conveying surface 22A of the conveying belt 22, is stuck onto the conveying surface 22A by way of the suction force, and is conveyed to the other side in the conveying direction X. Ink is discharged from a ink-injecting recording head 30 of the nozzle unit 3 to be described later toward the recording sheet T thus conveyed in a state of being stuck onto the conveying surface 22A of the conveying belt 22, thereby recording (printing) an image and the like on the recording sheet T.

As shown in FIGS. 1 to 3, the nozzle unit 3 has a nozzle unit base member 32 and the recording heads 30.

The nozzle unit base member 32 is a base member that supports the recording heads 30.

The recording head 30 is supported by the nozzle unit base member 32, and a plurality (four in the present embodiment) of recording heads 30 is provided in rows parallel to each other and evenly spaced apart in the conveying direction X. The recording heads 30 extend in a direction Y (hereinafter also referred to as a "lateral direction") that is orthogonal to the conveying direction X in the horizontal plane.

Each of the recording heads 30 has a nozzle face 31 in a lower end portion thereof. The nozzle face 31 is opposed to the conveying surface 22A of the conveying belt 22. Injection orifices (not shown) of ink-injecting nozzles (not shown) are formed on the nozzle face 31. Moreover, the ink-injecting nozzles are provided on substantially the entire area of the nozzle face 31 in the lateral direction Y. It should be noted that the ink-injecting nozzles are not provided to the periphery of the nozzle face 31.

The conveying unit 2 is configured to be capable of lifting and lowering (moving) with respect to the nozzle unit 3 by way of a first lifting and lowering mechanism (not shown) in a direction Z (hereinafter also referred to as a "vertical direction Z") perpendicular to the horizontal plane. Such movement of the conveying unit 2 in the vertical direction Z allows the conveying surface 22A of the conveying belt 22 to relatively approach or depart away from the nozzle face 31 of the recording head 30 opposite to the conveying surface 22A.

As shown in FIGS. 2 and 4A to 4C, the cap unit 5 includes nozzle cap members 50, axle members 51, a nozzle cap base member 52, stoppers 53, and coil springs 54.

The nozzle cap base member 52 is a tabular base member that supports the nozzle cap members 50 via the axle members 51 and the like.

The nozzle cap base member 52 includes through-holes 52A in positions corresponding to the axle members 51. The nozzle cap members 50 cover the nozzle faces 31 of the recording heads 30 in the nozzle unit 3, and include the same number of members as the recording heads 30 (four in the present embodiment). The nozzle cap members 50 extend in the lateral direction Y.

The axle members 51 (two in total) are fixed and connected underneath the vicinities of both ends of each nozzle cap member 50 in the lateral direction Y. The axle members 51 are passed through the through-holes 52A of the nozzle cap base member 52, and include the stoppers 53.

The stoppers 53 are connected to lower end portions of the axle members 51 (end portions of the nozzle cap base member 52), and have an external diameter that is larger than a diameter of the through-holes 52A.

The coil springs 54 are disposed to surround the peripheries of the axle members 51 between the nozzle cap members 50 and the nozzle cap base member 52. As a result, the nozzle cap members 50 are biased upward in the vertical direction Z against the nozzle cap base member 52 due to the elastic force of the coil springs 54. Accordingly, when covering the nozzle faces 31 of the recording heads 30, the nozzle cap members 50 elastically come into tight contact with the nozzle faces 31.

The cap unit 5 is disposed at one side of the conveying unit 2 and the nozzle unit 3 in the lateral direction Y (an upper side in FIG. 1 and a right side in FIG. 2). A direction originating from the cap unit 5 in this state toward the conveying unit 2 and the nozzle unit 3 is also referred to as a "second direction Y2." The cap unit 5 is configured such that when the conveying unit 2 has moved downward in the vertical direction Z and the conveying surface 22A has been sufficiently separated from the nozzle faces 31 of the nozzle unit 3(see FIG. 13), the cap unit 5 can be moved by a second horizontal movement mechanism (not shown) in the second direction Y2 so as to be disposed in a conveying space A between the conveying surface 22A and the nozzle faces 31 (see FIG. 13). The operation of the second horizontal movement mechanism allows the cap unit 5 to be movable between a standby position P1 and a nozzle cap position P2. The standby position P1 is shown as a solid line in FIGS. 1 and 2 and as a virtual line in FIGS. 12 and 13. The nozzle cap position P2 is shown as a solid line in FIGS. 12 and 13.

Figure 5A:
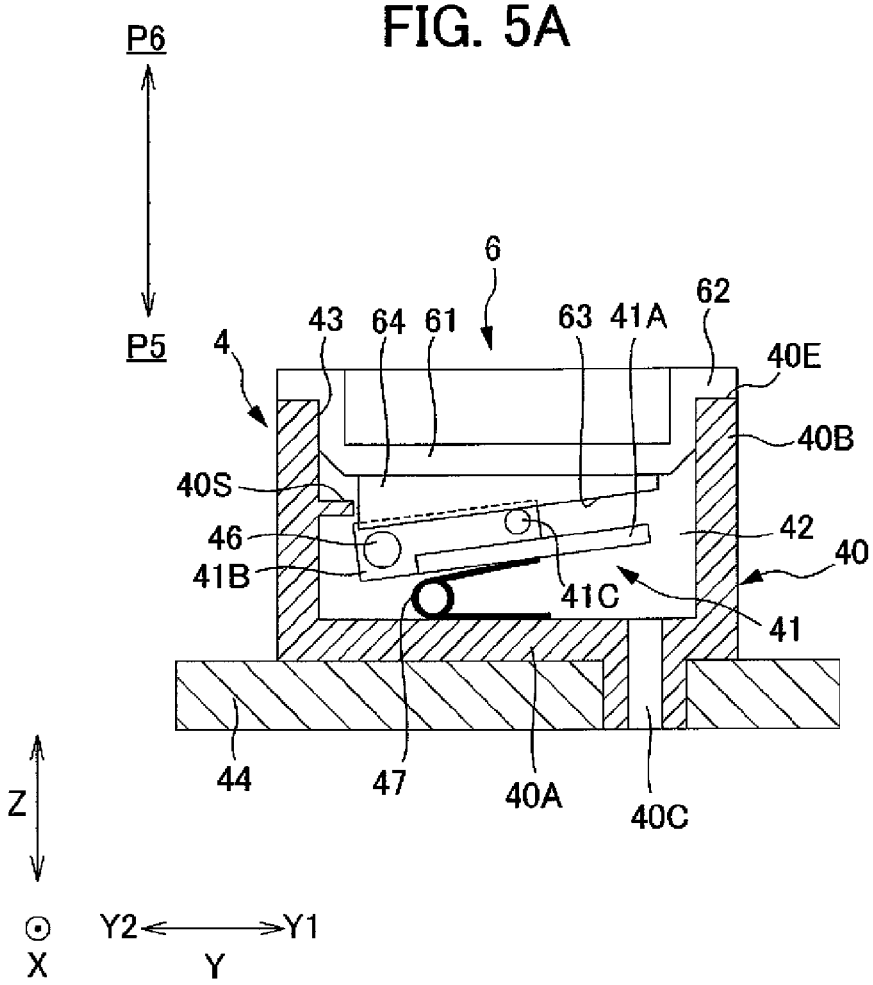
FIG. 5A is a vertical cross-sectional view showing a state in which a wiper opening 43 of a cleaning unit 4 in the first embodiment is shut by a wiper cap member 6.
Figure 5B:
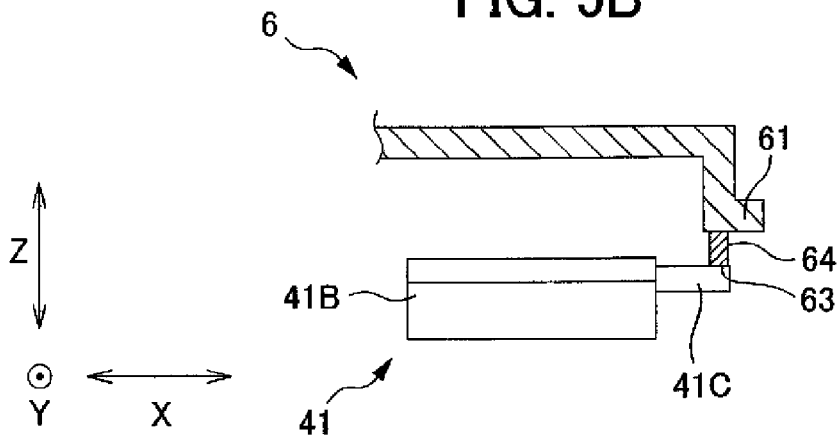
FIG. 5B is a partial cross-sectional view in which a wiper member 41 and the wiper cap member 6 as shown in FIG. 5A are viewed in a first direction Y1.

Next, a configuration relating to characteristic portions in the inkjet recording device 1 of the first embodiment is described with reference to the drawings. FIG. 5A is a vertical cross-sectional view showing a state in which a wiper opening 43 of the cleaning unit 4 in the first embodiment is shut by the wiper cap member 6. FIG. 5B is a partial cross-sectional view in which a wiper member 41 and the wiper cap member 6 shown in FIG. 5A are viewed in a first direction Y1.

Figure 6A:
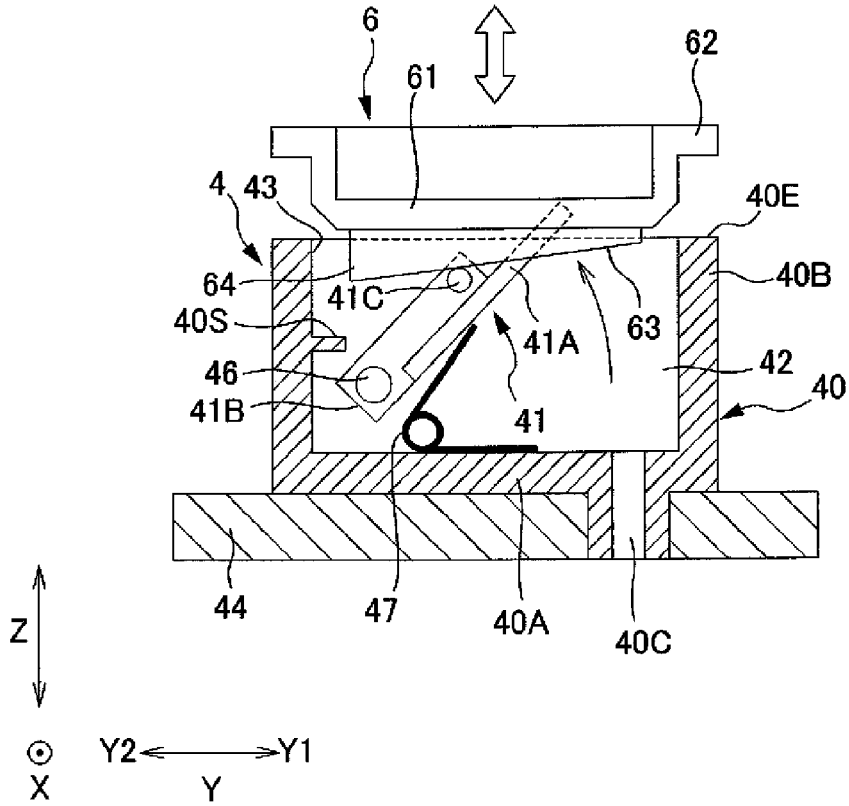
FIG. 6A is a vertical cross-sectional view illustrating a state in which the cap member 6 is slightly separated from the wiper opening 43 of the cleaning unit 4 in the first embodiment.
Figure 6B:
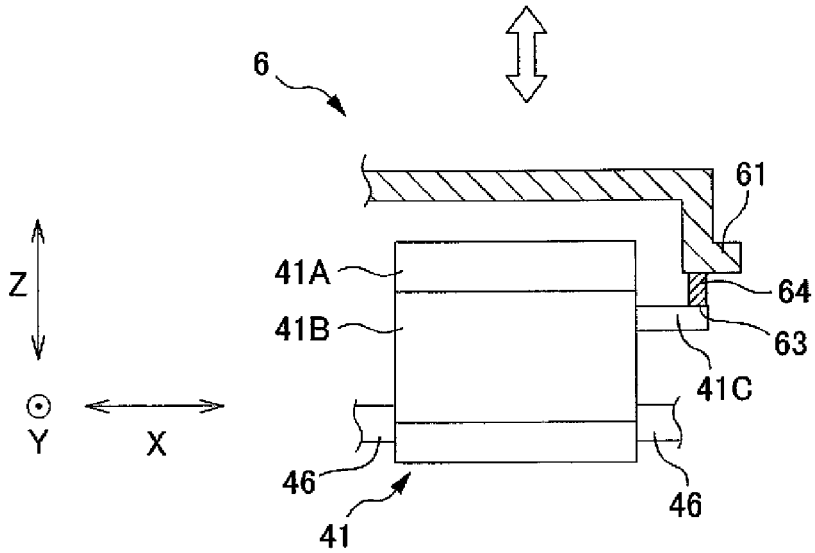
FIG. 6B is a partial cross-sectional view in which the wiper member 41 and the wiper cap member 6 as shown in FIG. 6A are viewed in the first direction Y1.
Figure 7A:
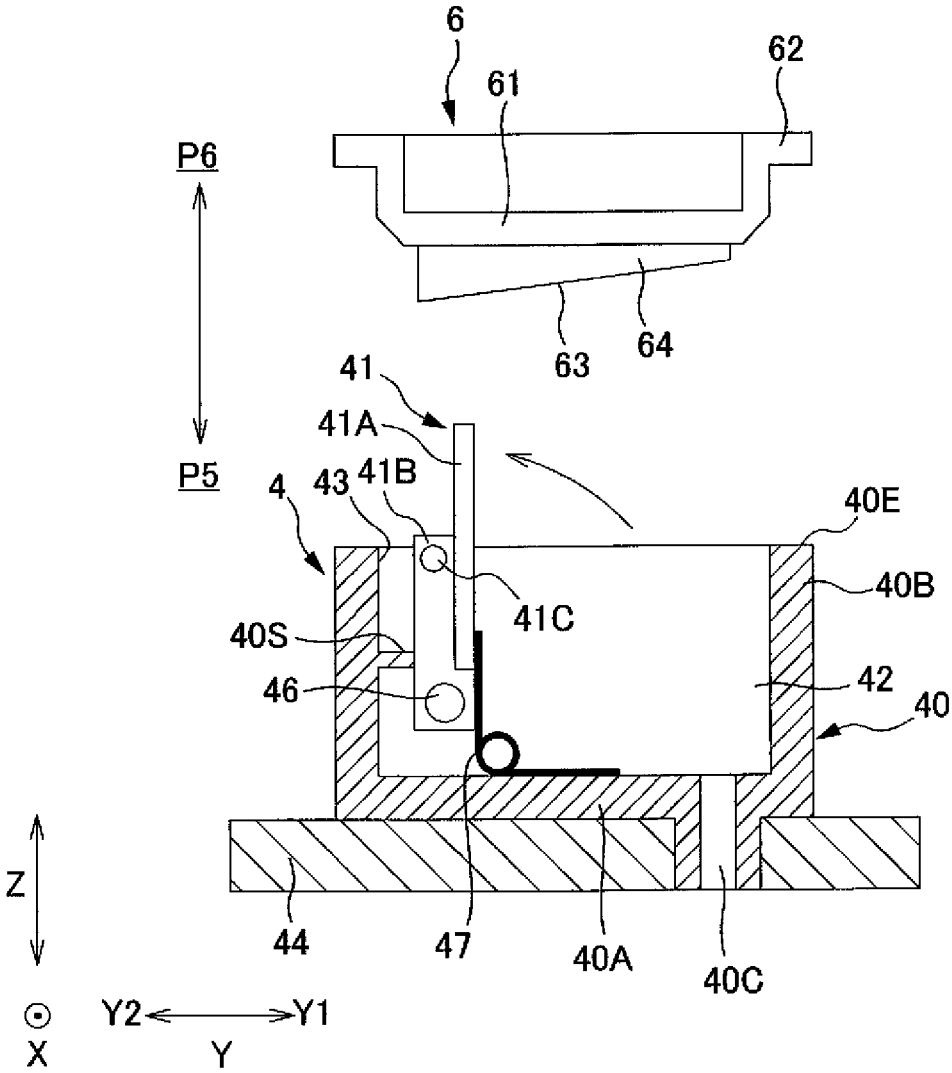
FIG. 7A is a vertical cross-sectional view showing a state in which the wiper cap member 6 is completely separated from the wiper opening 43 of the cleaning unit 4 in the first embodiment.
Figure 7B:
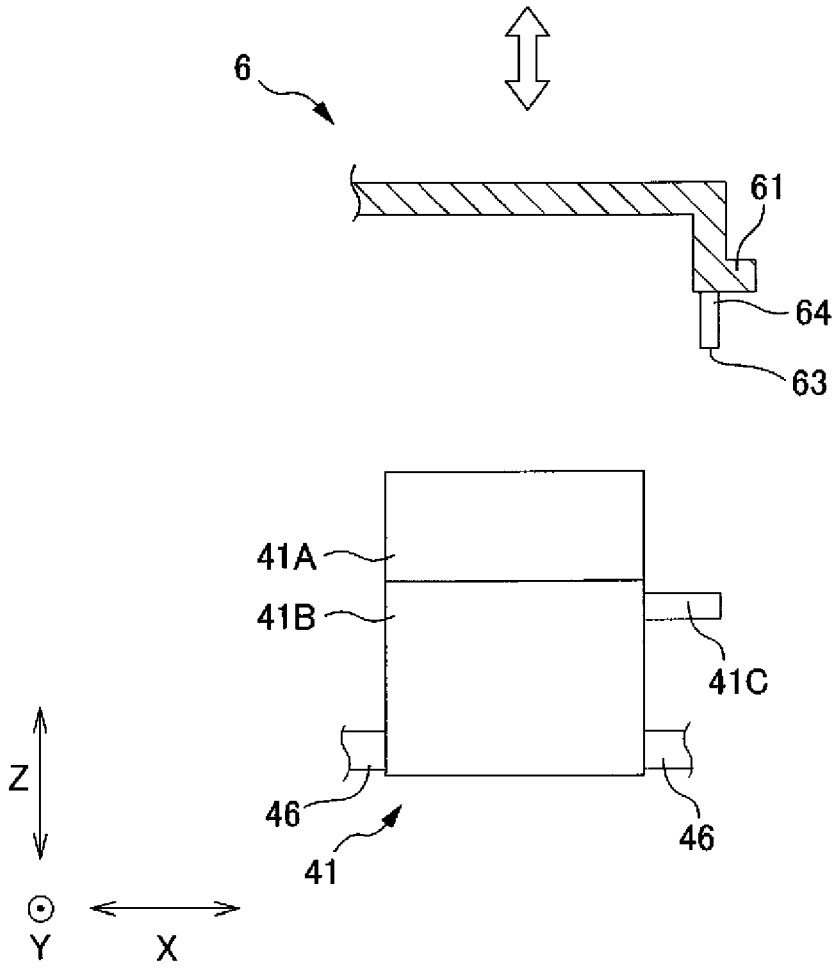
FIG. 7B is a partial cross-sectional view in which the wiper member 41 and the wiper cap member 6 as shown in FIG. 7A are viewed in the first direction Y1.

FIG. 6A is a vertical cross-sectional view illustrating the cap member 6 being slightly away from the wiper opening 43 of the cleaning unit 4 in the first embodiment. FIG. 6B is a partial cross-sectional view in which the wiper member 41 and the wiper cap member 6 as shown in FIG. 6A are viewed in the first direction Y1. FIG. 7A is a vertical cross-sectional view showing the wiper cap member 6 being completely away from the wiper opening 43 of the cleaning unit 4 in the first embodiment. FIG. 7B is a partial cross-sectional view in which the wiper member 41 and the wiper cap member 6 as shown in FIG. 7A are viewed in the first direction Y1.

As shown in FIGS. 5A to 7B, the cleaning unit 4 includes a wiper case 40, a wiper member 41, a cleaning unit base member 44, an axle member 46, and a spring 47.

The cleaning unit base member 44 supports the wiper case 40. The wiper case 40 has a wiper accommodating portion 42 and the wiper opening 43. The wiper accommodating portion 42 can accommodate the wiper member 41. The wiper opening 43 is located in an upper portion of the wiper case 40. As shown in FIG. 1, the quantity of wiper cases 40 is the same (four in the present embodiment) as the nozzle faces 31 of the recording heads 30. Similarly to the nozzle cap members 50, the wiper cases 40 are disposed to be evenly spaced apart from one another in the conveying direction X, and are fixed on the cleaning unit base member 44.

An ejection port 40C is formed in a bottom wall 40A of the wiper case 40. The ejection port 40C penetrates through the cleaning unit base member 44 to communicate openly downward in the vertical direction Z. The ejection port 40C ejects ink, which is cleaned off from the nozzle face 31 by the wiper member 41, to an outside of the wiper accommodating portion 42.

Moreover, a stopper part 40S is provided on an inside of a side wall 40B of the wiper case 40. The stopper part 40S abuts a support member 41B of the wiper member 41 to be described later, thereby limiting pivoting of the wiper member 41.

As shown in FIGS. 5A to 7B, the wiper member 41 has a wiping portion 41A, the support member 41B that supports the wiping portion 41A, a depressed portion 41C that is depressed by a depression slope 63 of a protrusion portion 64 (to be described later).

The wiping portion 41A is composed of, for example, rubber such as urethane rubber or ethylene-propylene-diene monomer rubber (EPDM).

The axle member 46 protrudes out from the support member 41B to both sides in the conveying direction X. The wiper member 41 is accommodated in the wiper accommodating portion 42 of the wiper case 40, and is pivotally supported by the wiper case 40 via the axle member 46. As a result, the wiper member 41 is configured such that the wiping portion 41A can protrude to the outside of the wiper accommodating portion 42 via the wiper opening 43 by way of the support member 41B pivoting about the axle member 46.

The depressed portion 41C protrudes out from one side of the support member 41B in the conveying direction X. The depressed portion 41C is provided at a position lying apart from the axle member 46, in a direction of the wiper member 41 extending orthogonally to an axial direction of the axle member 46.

The spring 47 is disposed between the wiper member 41 and the bottom wall 40A of the wiper case 40. The spring 47 is a torsion coil spring, for example. The spring 47 functions as a biasing member that biases the wiper member 41 to pivot toward the wiper opening 43. When the wiper member 41 pivots due to the biasing force of the spring 47 and stands substantially erect as shown in FIG. 7A, the support member 41B abuts the stopper part 40S to restrict the support member 41B from pivoting. In this way, the wiper member 41 is held to stand substantially erect.

The cleaning unit 4 is disposed on the other side of the conveying unit 2 and the nozzle unit 3 in the lateral direction Y (a lower side in FIG. 1 and a left side in FIG. 2). A direction originating from the cleaning unit 4 in this state toward the conveying unit 2 and the nozzle unit 3 is also referred to as a "first direction Y1." The cleaning unit 4 is configured such that when the conveying unit 2 has moved downward in the vertical direction Z and the conveying surface 22A is sufficiently apart from the nozzle faces 31 of the nozzle unit 3 (see FIG. 9), the cleaning unit 4 can move in the first direction Y1 by way of a first horizontal movement mechanism (not shown), and can be disposed in the conveying space A between the conveying surface 22A and the nozzle faces 31 (see FIG. 9). The cleaning unit 4 is configured to be movable between a standby position P3 and a turning-back position P4 by way of the operation of the first horizontal movement mechanism. The standby position P3 is shown as a solid line in FIGS. 1 and 2 and as a virtual line in FIGS. 8 and 9. The turning-back position P4 is shown as a solid line in FIGS. 8 and 9.

As shown in FIGS. 5A to 78, the wiper cap member 6 includes an inner portion 61, a flange 62, and the protrusion portion 64 having a depression slope 63.

The inner portion 61 fits into the wiper accommodating portion 42 of the wiper case 40 to shut the wiper opening 43.

The flange 62 abuts a top surface 40E of the side wall 40B of the wiper case 40 when the inner portion 61 fits into the wiper accommodating portion 42.

The protrusion portion 64 is a tabular portion protruding underneath the inner portion 61, and has the depression slope 63. The depression slope 63 has a surface that slants with respect to a plane (XY plane) that is orthogonal to a direction (downward direction Z) in which the wiper cap member 6 approaches the wiper opening 43.

The wiper cap member 6 is disposed above the standby position P3 of the cleaning unit 4 in the vertical direction Z, and is configured to be capable of lifting and lowering (moving) in the vertical direction Z via a second lifting and lowering mechanism (not shown). The wiper cap member 6 is configured to be movable between a shutting position P5 for shutting the wiper opening 43 of the wiper case 40 shown in FIG. 5A and a standby position P6 shown in FIG. 7A, by way of lifting and lowering performed by the second lifting and lowering mechanism.

As shown in FIGS. 7A, 7B, 6A, 6B, 5A and 5B in this order, when the wiper cap member 6 moves downward in the vertical direction Z toward the shutting position P5 to shut the wiper opening 43, the depressed portion 41C of the wiper member 41 is depressed by the depression slope 63 of the wiper cap member 6. As a result, the wiper member 41 is pivoted in a direction away from the wiper opening 43 against the biasing force of the spring 47. In addition, as shown in FIG. 5A, when the wiper cap member 6 is lowered to the shutting position P5, the wiper member 41 is completely accommodated in the wiper accommodating portion 42 of the wiper case 40.

Figure 8:
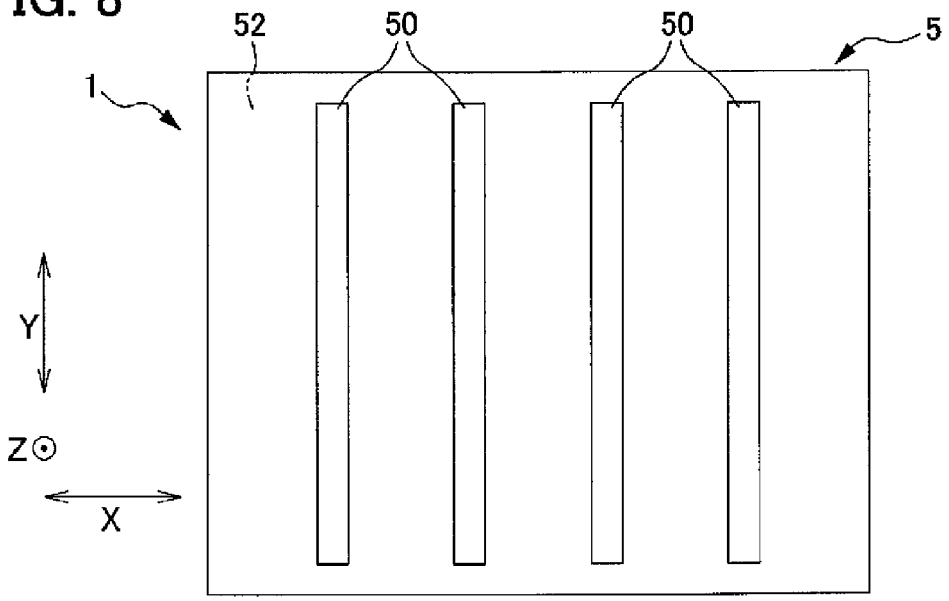
FIG. 8 is a plan view showing a range of movement of the cleaning unit 4 in the first embodiment.
Figure 8:
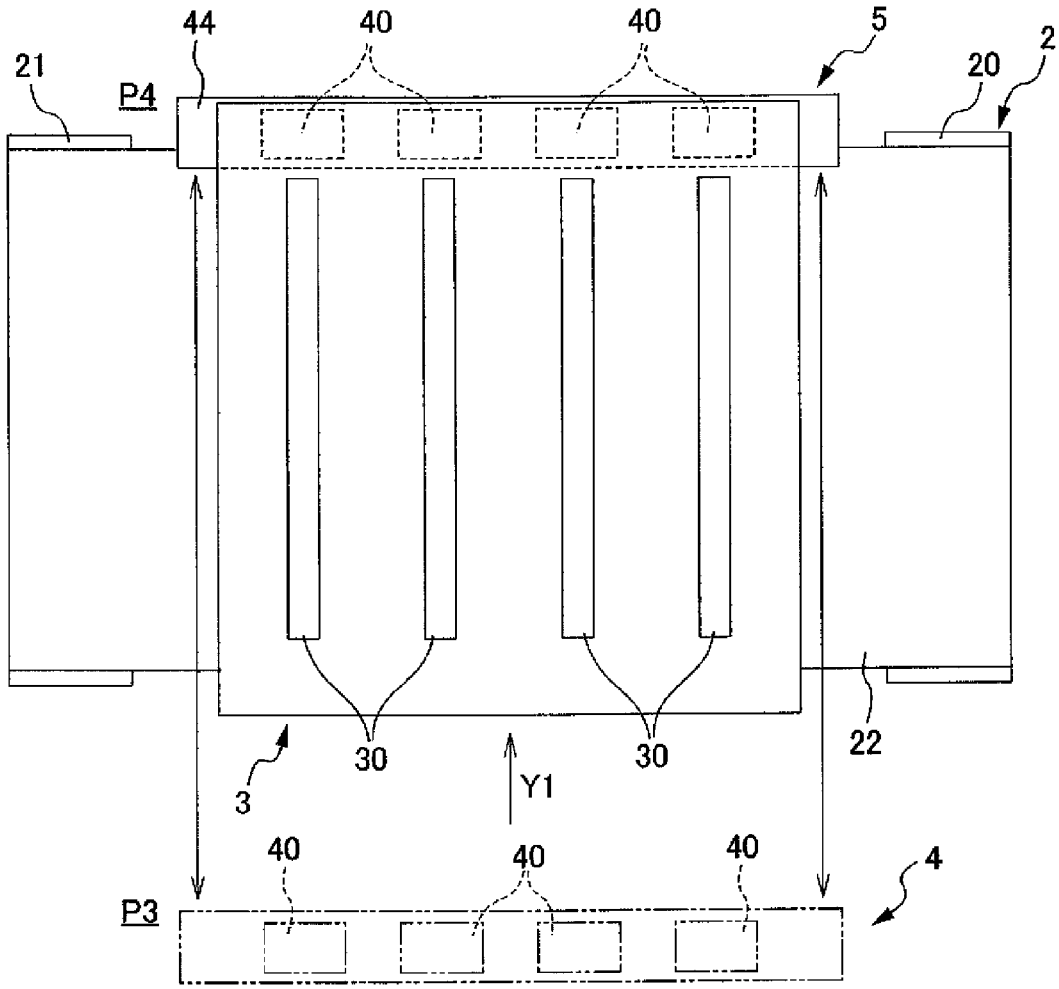
Figure 9:
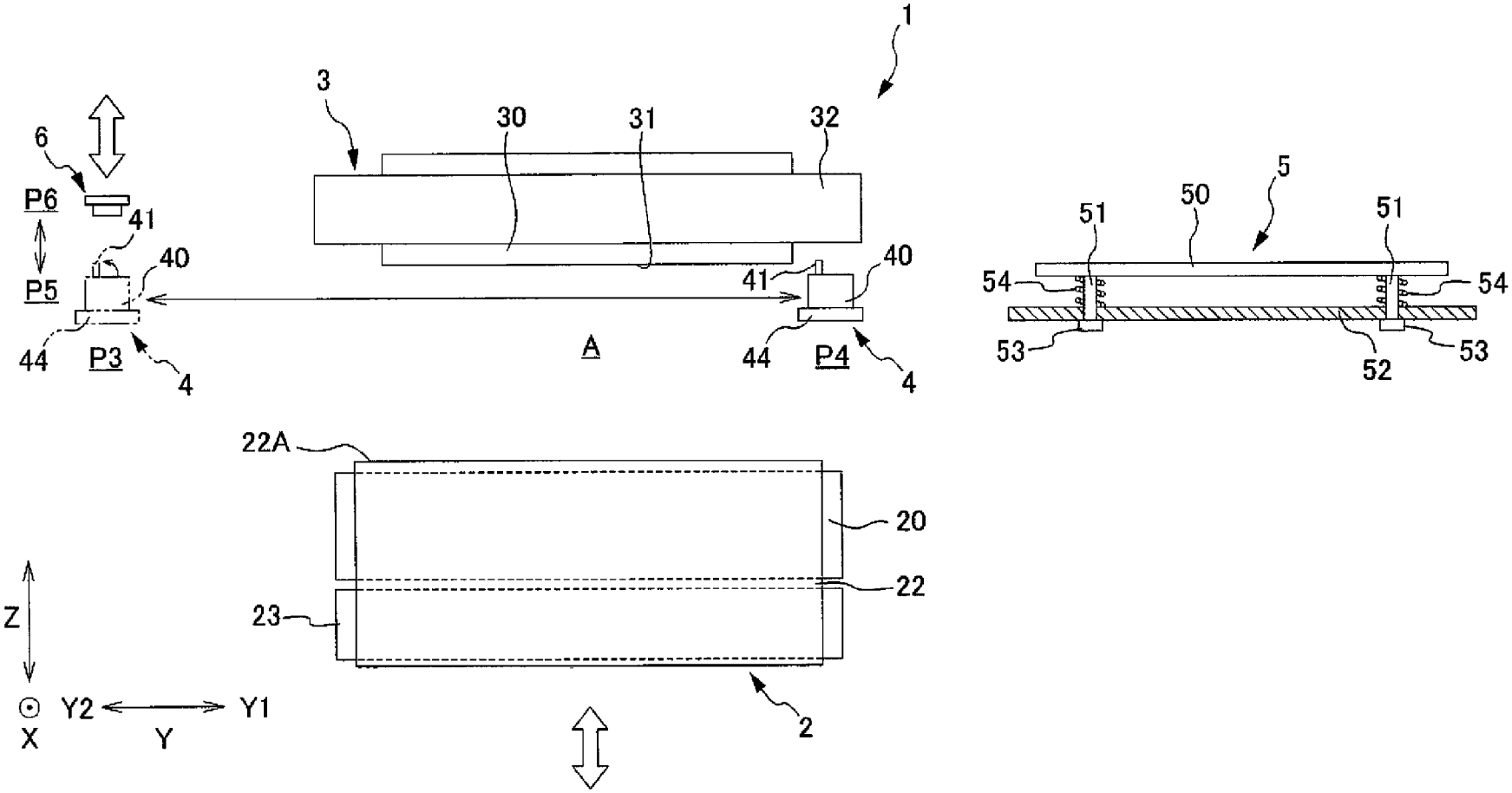
FIG. 9 is a right side view showing the range of movement of the cleaning unit 4 in the first embodiment.
Figure 10:
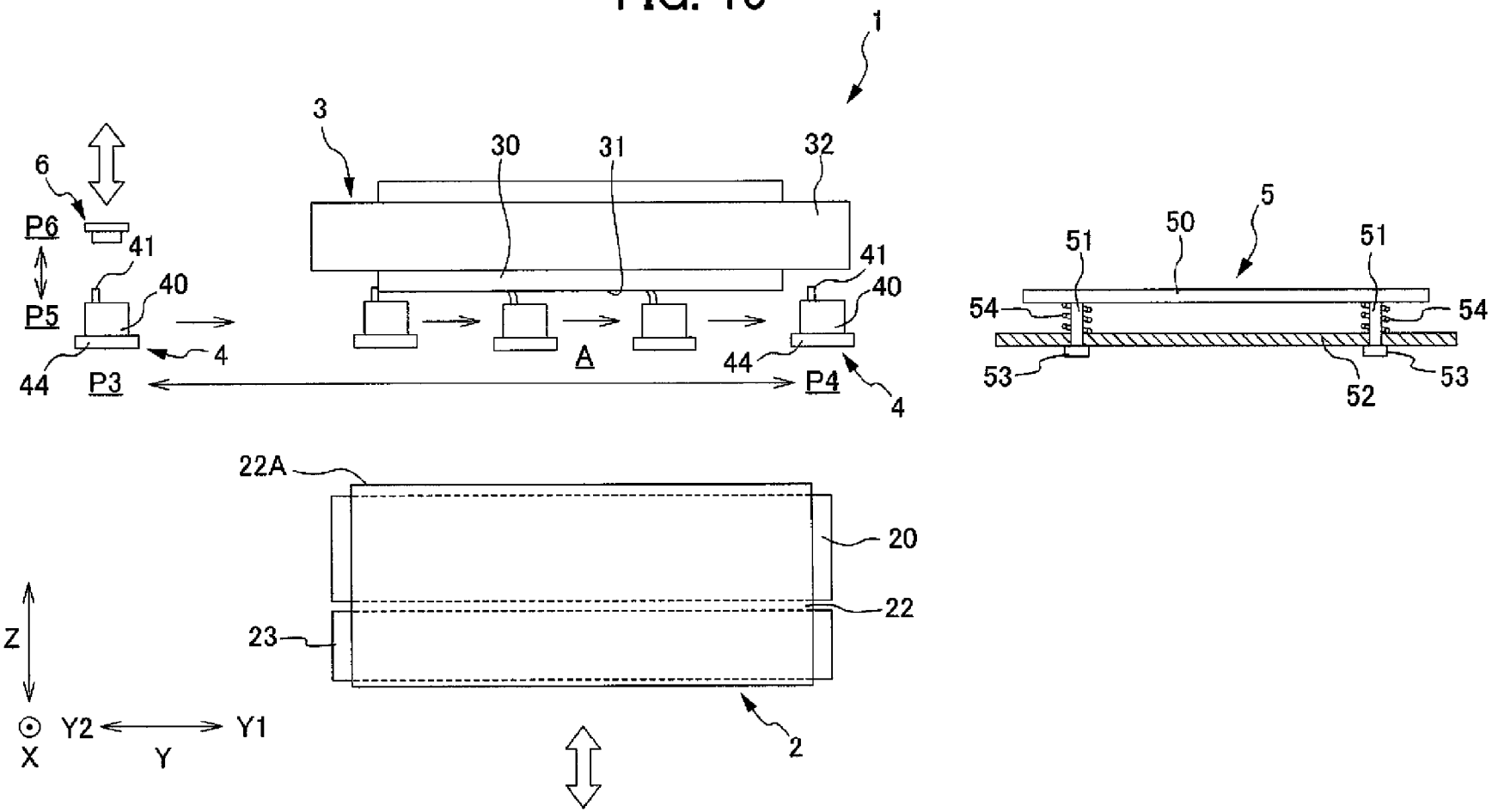
FIG. 10 is a right side view illustrating a process in which the cleaning unit 4 in the first embodiment moves in the first direction Y1 to clean the nozzle faces 31 of the recording heads 30.
Figure 11:
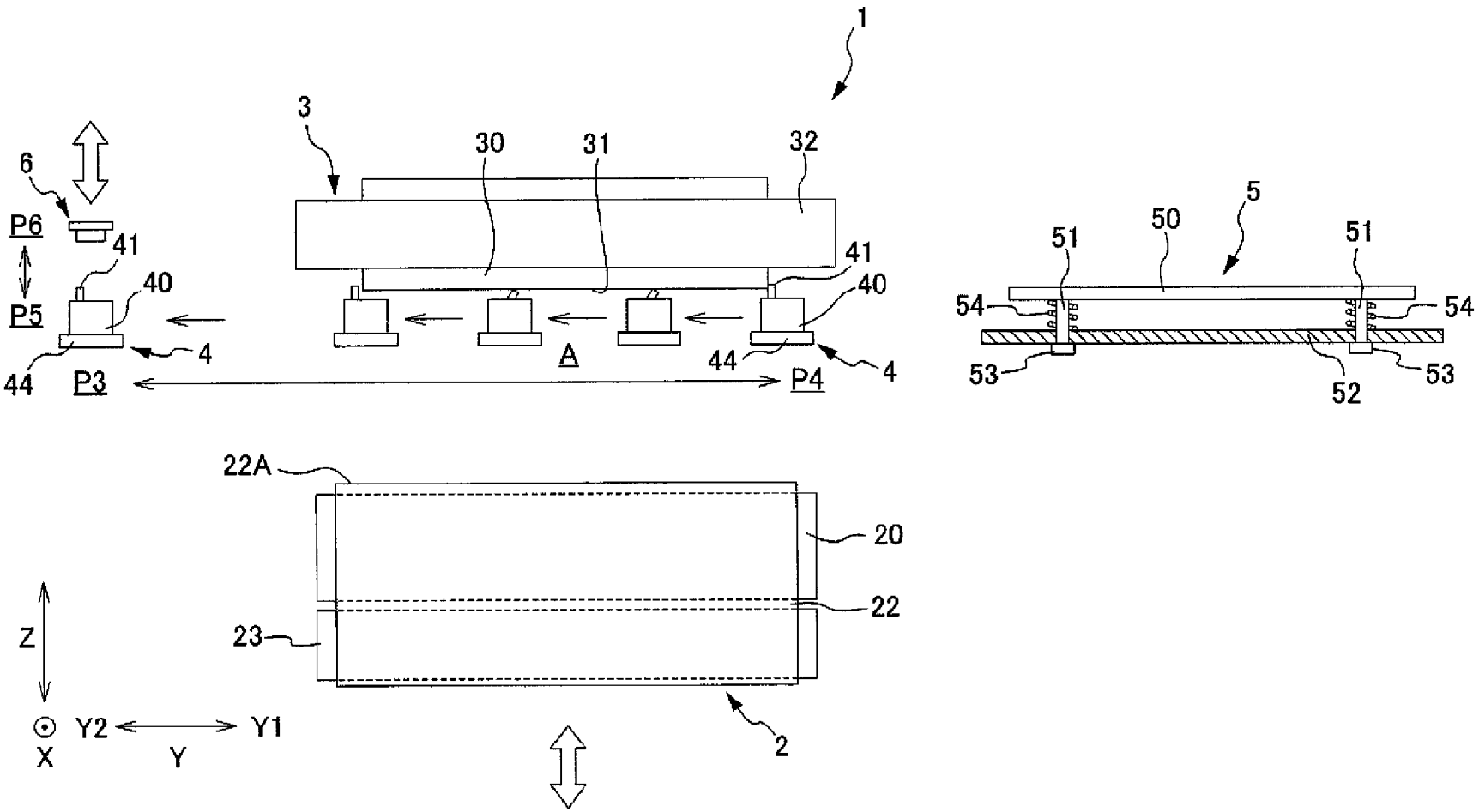
FIG. 11 is a right side view illustrating a process in which the cleaning unit 4 in the first embodiment moves in a second direction Y2 to clean the nozzle faces 31 of the recording heads 30.

Next, operation of the inkjet recording device 1 of the first embodiment is described with reference to FIGS. 8 to 14. FIG. 8 is a plan view showing a range of movement of the cleaning unit 4 in the first embodiment. FIG. 9 is a right side view showing the range of movement of the cleaning unit 4 in the first embodiment. FIG. 10 is a right side view illustrating a process in which the cleaning unit 4 in the first embodiment moves in the first direction Y1 to clean the nozzle faces 31 of the, recording heads 30. FIG. 11 is a right side view illustrating a process in which the cleaning unit 4 in the first embodiment moves in the second direction Y2 to clean the nozzle faces 31 of the recording heads 30.

As shown in FIGS. 1 to 3, the recording sheet T, which has been introduced onto the conveying surface 22A of the conveying belt 22 via the drive roller 20, is stuck onto the conveying surface 22A by the suction force acting on the conveying belt 22 due to the operation of the suction unit 24, and is conveyed from one side to the other side in the conveying direction X. Ink is discharged toward the recording sheet T conveyed on the conveying surface 22A from ink-injecting recording heads 30 of the nozzle unit 3, thereby recording (printing) an image and the like on the recording sheet T.

As shown in FIGS. 1 and 2, when recording is in process, the cap unit 5 stands by at the standby position P1, and the cleaning unit 4 stands by at the standby position P3. Moreover, the wiper cap member 6 is disposed at the shutting position P5, and shuts the wiper opening 43 of the wiper case 40 in the cleaning unit 4.

After the completion of recording an image or the like, the first lifting and lowering mechanism starts to operate. The operation of the first lifting and lowering mechanism causes the conveying unit 2 to move downward in the vertical direction Z. As shown in FIGS. 9 to 11, the movement of the conveying unit 2 allows the conveying surface 22A of the conveying belt 22 to be sufficiently apart from the nozzle faces 31 of the recording heads 30, so that the conveying space A is formed between the conveying surface 22A and the nozzle faces 31.

Next, the second lifting and lowering mechanism starts to operate. As shown in FIGS. 9 to 11, due to the operation of the second lifting and lowering mechanism, the wiper cap member 6 moves upward in the vertical direction Z to be disposed at the standby position P6. As shown in FIGS. 5A, 5B, 6A and 6B, with the movement of the wiper cap member 6, the pressing force applied to the depressed portion 41C of the wiper member 41 by the depression slope 63 is gradually released. In addition, the wiper member 41 in the cleaning unit 4 pivots about the axle member 46 due to the biasing force of the spring 47. Subsequently, when the wiper member 41 pivots to stand substantially erect, as shown in FIG. 7A, the support member 41B abuts the stopper part 40S to restrict the wiper member 41 from pivoting, holding the wiper member 41 to stand substantially erect.

Subsequently, the first horizontal movement mechanism starts to operate. As shown in FIG. 10, the operation of the first horizontal movement mechanism allows the cleaning unit 4 to move in the first direction Y1 to sit in the conveying space A. In other words, the cleaning unit 4 moves in the first direction Y1 from the standby position P3 to the turning-back position P4. The standby position P3 is shown as the solid line in FIGS. 1 and 2 and the virtual line in FIGS. 8 and 9. The turning-back position P4 is shown as the solid line in FIGS. 8 and 9. During movement of this cleaning unit 4, the wiper member 41 is held to stand substantially erect due to the stopper part 40S limiting the pivoting of the wiper member 41. Since the wiping portion 41A is elastic, the wiper member 41 bends, so that a tip of the wiping portion 41A elastically contacts the nozzle faces 31 of the recording heads 30. With the wiper member 41 moving in the first direction Y1 under such a condition, the nozzle faces 31 of the recording heads 30 are cleaned (wiped).

In addition, when the cleaning unit 4 has moved to the turning-back position P4 and has stopped, the first horizontal movement mechanism starts to operate in the reverse way. As shown in FIG. 11, due to the reverse operation of the first horizontal movement mechanism, the cleaning unit 4 moves in the second direction Y2 from the turning-back position P4 toward the standby position P3. During this movement of the cleaning unit 4, since the pivoting of the wiper member 41 is not limited by the stopper part 40S, the wiper member 41 pivots about the axle member 46 toward the bottom wall 40A of the wiper case 40.

As a result of this pivoting, the wiper member 41 is inclined such that a tip side of the wiping portion 41A is oriented in the first direction Y1 opposite to the movement direction. The wiper member 41 inclined as described above seldom bends, and the tip of the wiping portion 41A elastically contacts the nozzle faces 31 of the recording heads 30 due to the elastic force of the spring 47. With the wiper member 41 moving in the second direction Y2 under such a condition, the nozzle faces 31 of the recording heads 30 are cleaned.

As described above, the wiper member 41 of the cleaning unit 4 cleans the nozzle faces 31 of the recording heads 30 in both back and forth movements of the cleaning unit 4 (when moving in the first direction Y1 and the second direction Y2). In addition, when the cleaning unit 4 has completed the cleaning to move to the standby position P3, the second lifting and lowering mechanism then starts to operate in the reverse way. The operation of the second lifting and lowering mechanism in the reverse way allows the wiper cap member 6 in the standby position P6 to move downward in the vertical direction Z to sit in the shutting position P5 (see FIG. 13). The wiper cap member 6 disposed in the shutting position P5 shuts the wiper opening 43 of the wiper case 40.

As shown in FIGS. 7A, 7B, 6A, 6B, 5A and 5B, when the wiper cap member 6 moves downward in the vertical direction Z to shut the wiper opening 43, the depressed portion 41C of the wiper member 41 is depressed by the depression slope 63 of the wiper cap member 6. As a result, the wiper member 41 is pivoted about the axle member 46 in a direction away from the wiper opening 43 against the biasing force of the spring 47. In addition, when the wiper cap member 6 is lowered to the shutting position P5, the wiper member 41 is accommodated in the wiper accommodating portion 42 of the wiper case 40.

As described above, since the wiper cap member 6 disposed at the shutting position P5 shuts the wiper opening 43 of the wiper case 40, the wiper member 41 with the wiping portion 41A, to the vicinity of the tip of which the ink is adhered after finishing cleaning of the nozzle faces 31, is confined in the, wiper accommodating portion 42 of the wiper case 40.

Under the condition described above, it should be noted that portions other than the depressed portion 41C in the wiper member 41 do not contact the wiper cap member 6. Accordingly, it is unlikely to damage the wiping portion 41A of the wiper member 41, etc.

Figure 12:
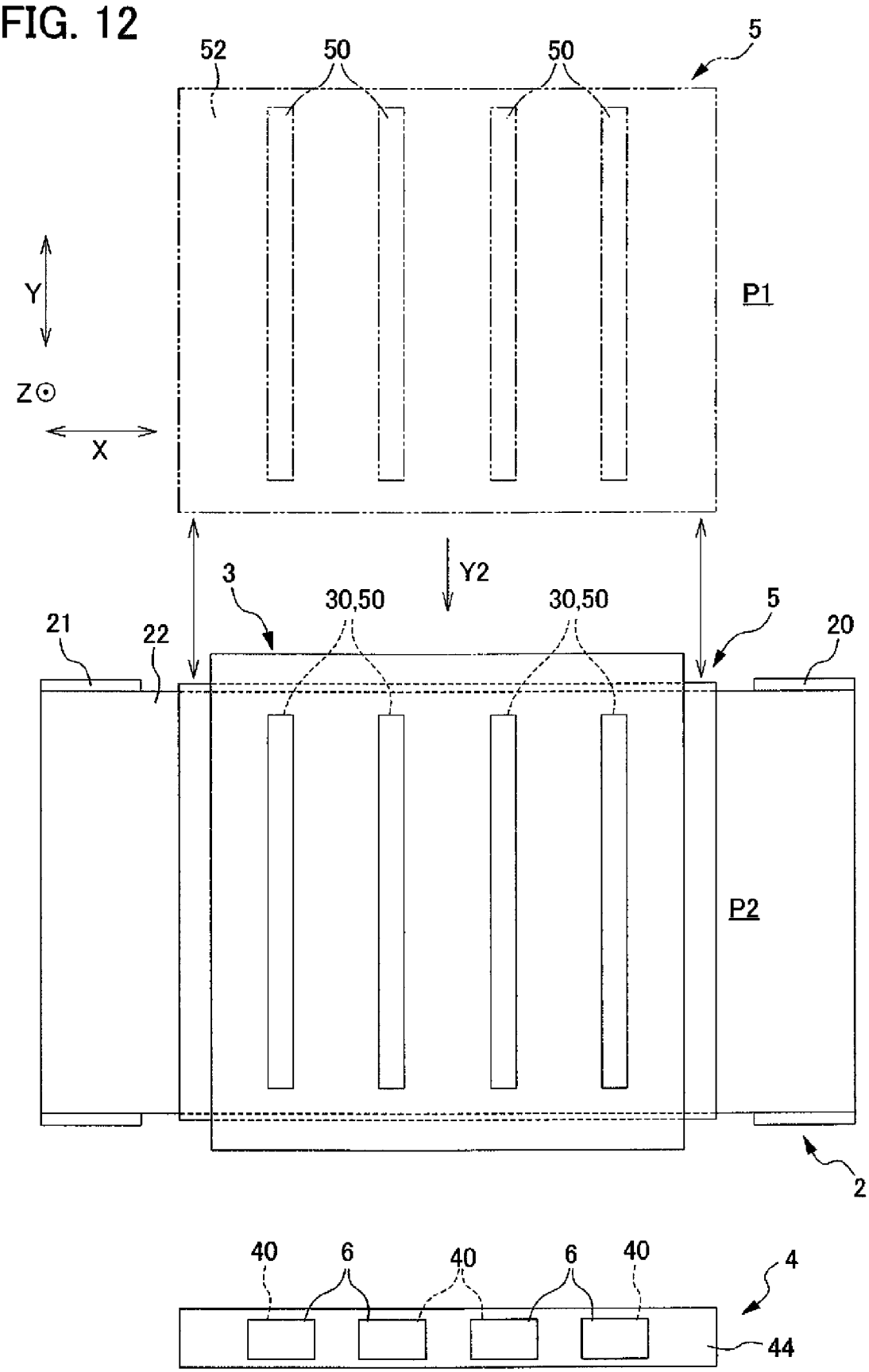
FIG. 12 is a plan view showing a range of movement of the cap unit 5 in the first embodiment.
Figure 13:
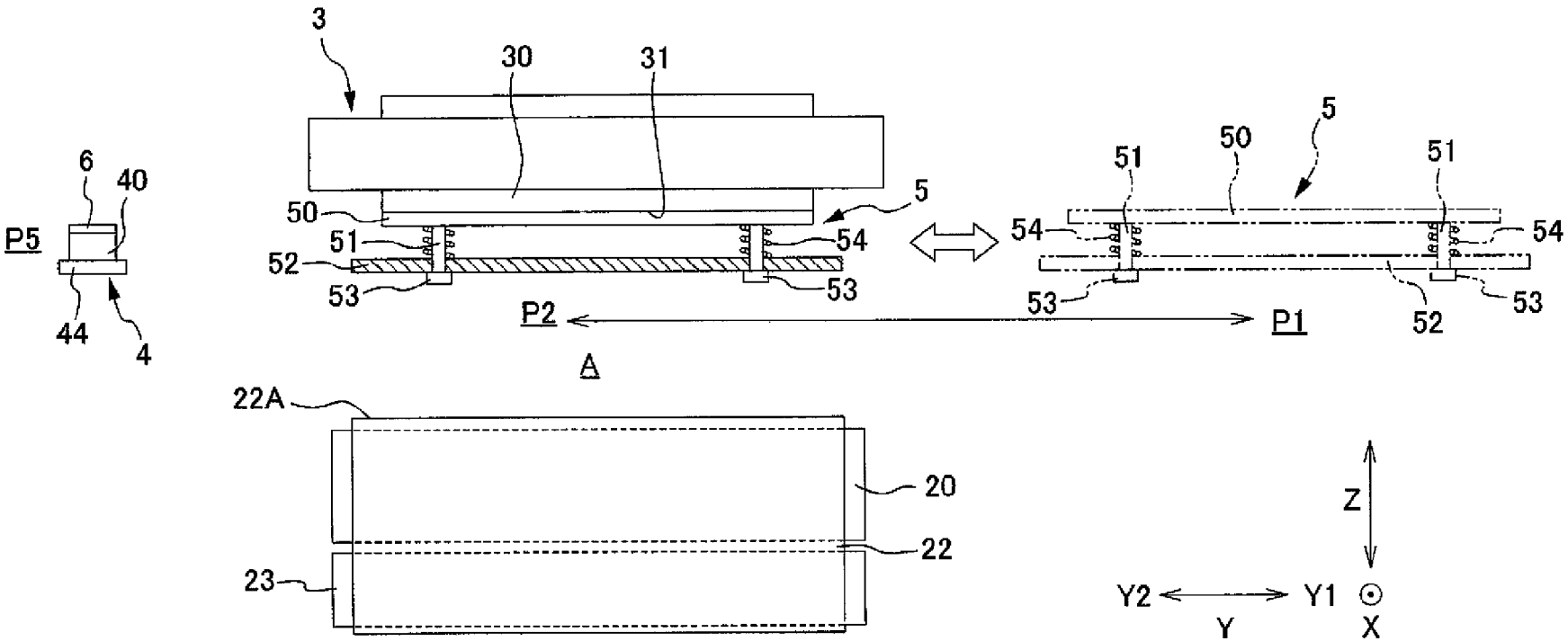
FIG. 13 is a right side view showing the range of movement of the cap unit 5 in the first embodiment.
Figure 14:
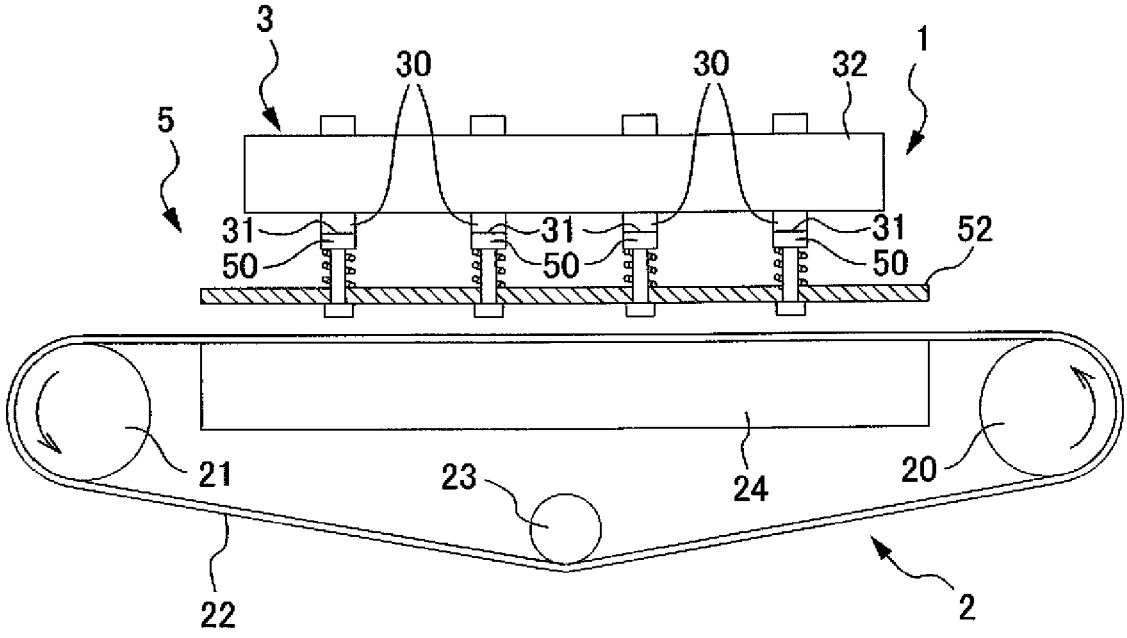
FIG. 14 is a front view showing a state in which the nozzle cap members 50 in the first embodiment cover the nozzle faces 31 of the recording heads 30.

Next, a description is provided for operation in which the nozzle cap members 50 of the cap unit 5 cover the nozzle faces 31 of the recording heads 30 after the cleaning unit 4 has completed the cleaning of the nozzle faces 31 of the recording heads 30. FIG. 12 is a plan view showing a range of movement of the cap unit 5 in the first embodiment. FIG. 13 is a right side view showing the range of movement of the cap unit 5 in the first embodiment. FIG. 14 is a front view showing a state in which the nozzle cap members 50 in the first embodiment cover the nozzle faces 31 of the recording heads 30.

As shown in FIGS. 12 to 14, even if the cleaning unit 4 has completed the cleaning, the conveying unit 2 is held to sit downward in the vertical direction Z. Accordingly, as shown in FIGS. 13 and 14, the conveying surface 22A of the conveying belt 22 is sufficiently apart from the nozzle faces 31 of the recording heads 30. Moreover, the conveying space A is formed between the conveying surface 22A and the nozzle faces 31.

Under the condition described above, the second horizontal movement mechanism starts to operate. As shown in FIGS. 12 to 14, the operation of the second horizontal movement mechanism allows the cap unit 5 to move in the second direction Y2 to sit in the conveying space A. In other words, the cap unit 5 moves in the second direction Y2 from the standby position P1 toward the nozzle cap position P2. The standby position P1 is shown as the solid line in FIGS. 1 and 2 and as the virtual line in FIGS. 12 and 13. The nozzle cap position P2 is shown as the solid line in FIGS. 12 to 14.

When the cap unit 5 has moved to the nozzle cap position P2, the nozzle cap members 50 move upward in the vertical direction Z, and elastically come into tight contact with the nozzle faces 31 of the recording heads 30. Since this shuts the ink-injecting nozzles of the recording heads 30, not only the ink is inhibited from flowing down, but also adhesion of floating dust, paper waste, etc. to the nozzle faces 31 is inhibited.

The aforementioned operation concludes a series of operations of recording an image and the like, cleaning the nozzle faces 31 and capping the nozzle faces 31. In addition, when an image and the like are subsequently recorded, the following operation is performed. The cap unit 5 is moved by the second horizontal movement mechanism toward the first direction Y1 to be disposed at the standby position P1, such that the nozzle cap members 50 are apart from the nozzle faces 31 of the recording heads 30. Next, the conveying unit 2 is lifted by the first lifting and lowering mechanism, so that the conveying surface 22A of the conveying belt 22 approaches the nozzle faces 31 of the recording heads 30. As a result, the inkjet recording device 1 is restored to the initial state shown in FIGS. 1 to 3, and recording of the next image and the like can be performed.

According to the inkjet recording device 1 of the first embodiment, the following effects are achieved.

The inkjet recording device 1 of the first embodiment includes the wiper cap members 6 that shut the wiper openings 43 of the wiper cases 40. Accordingly, the wiper members 41 after cleaning the nozzle faces 31 of the recording heads 30 are not left exposed, but the wiper openings can be shut by the wiper cap members 6 such that the wiper members 41 are confined in the wiper accommodating portions 42.

Accordingly, it is possible to prevent thickening or drying of ink adhered to the wiper members 41 in preparation for cleaning to be performed from the next time on. Accordingly, even if the nozzle faces 31 of the recording heads 30 are cleaned again by using the wiper members 41 to which ink is adhered, transfer and adhesion of the thickened ink to the recording heads 3 can be prevented. As a result, defective injection of ink is unlikely to occur in recording, so that it is possible to implement sharp and high-definition recording.

Moreover, in the first embodiment, the nozzle faces 31 of the recording heads 30 are covered with the nozzle cap members 50 after being cleaned by the wiper members 41 in the cleaning unit 4.

Accordingly, it is possible to prevent adhesion of floating dust or paper waste to the cleaned nozzle faces 31. In addition, shutting the ink-injecting nozzles of the recording heads 30 by the nozzle cap members 50 can prevent the ink from flowing down from the recording heads 30. Therefore, it is possible to further prevent the occurrence of defective injection of ink in recording.

Furthermore, in the first embodiment, the cleaning unit 4 includes the spring 47 that biases the wiper member 41 to pivot toward the wiper opening 43 of wiper case 40.

Accordingly, it is possible to merely perform a simple operation or control such as causing the wiper cap member 6 to rectilinearly approach and depart away from the wiper opening 43 such that the wiper member 41 after performing cleaning is mechanically and automatically switchable between two states: the wiper member 41 being accommodated in the wiper accommodating portion 42 and standing erect for cleaning.

Moreover, the wiper cap member 6 has the depression slope 63 that depresses the wiper member 41 during a process of shutting the wiper opening 43 by causing the wiper cap member 6 to approach the wiper opening 43 of the wiper case 40. Accordingly, the wiper member 41 can be smoothly pivoted.

Next, other embodiments of the present invention are described. The other embodiments are described mainly for differences with respect to the first embodiment. A detailed description is omitted for features similar to those in the first embodiment, utilizing the same reference symbols. In the other embodiments, the descriptions provided for the first embodiment are appropriately applied thereto unless otherwise described in particular. In addition, effects similar to those in the first embodiment are achieved in the other embodiments.

Second Embodiment

Figure 15:
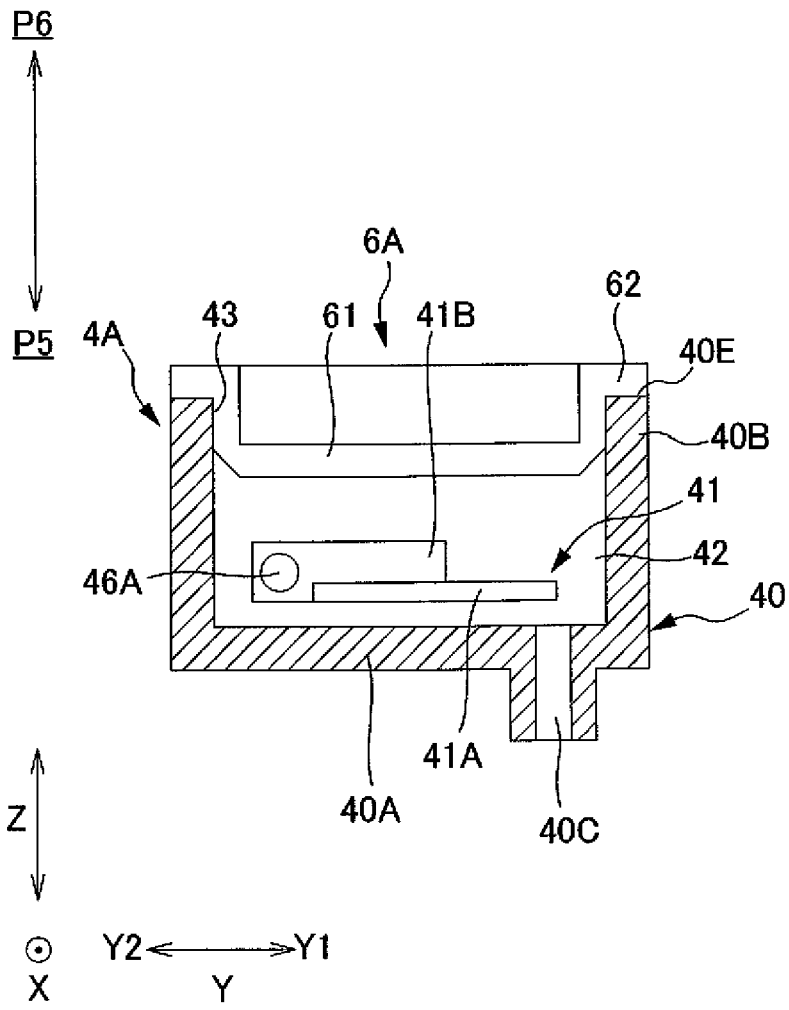
FIG. 15 is a vertical cross-sectional view showing a state in which the wiper opening 43 of a cleaning unit 4A in a second embodiment is shut by a wiper cap member 6A.
Figure 16A:
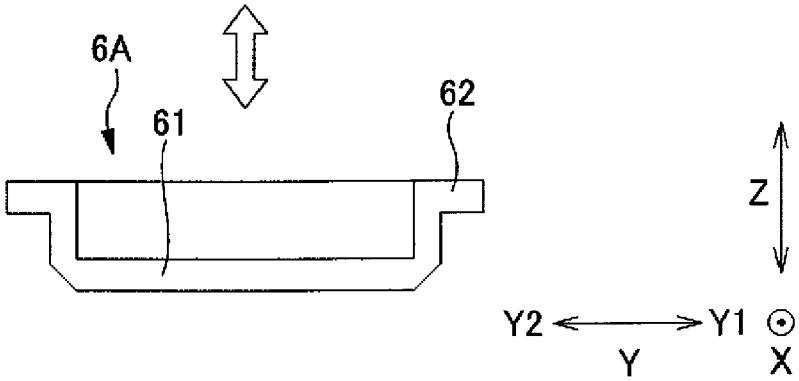
FIG. 16A is a vertical cross-sectional view in which the wiper cap member 6A in the second embodiment is viewed in a conveying direction X.
Figure 16B:
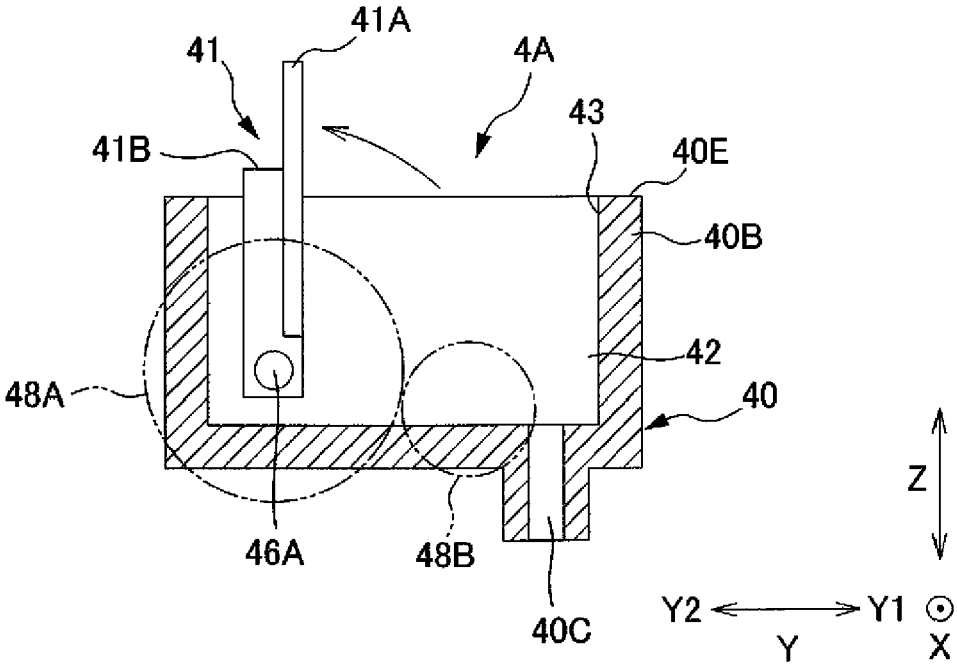
FIG. 16B is a vertical cross-sectional view in which the cleaning unit 4A in the second embodiment is viewed in the conveying direction X.
Figure 16C:
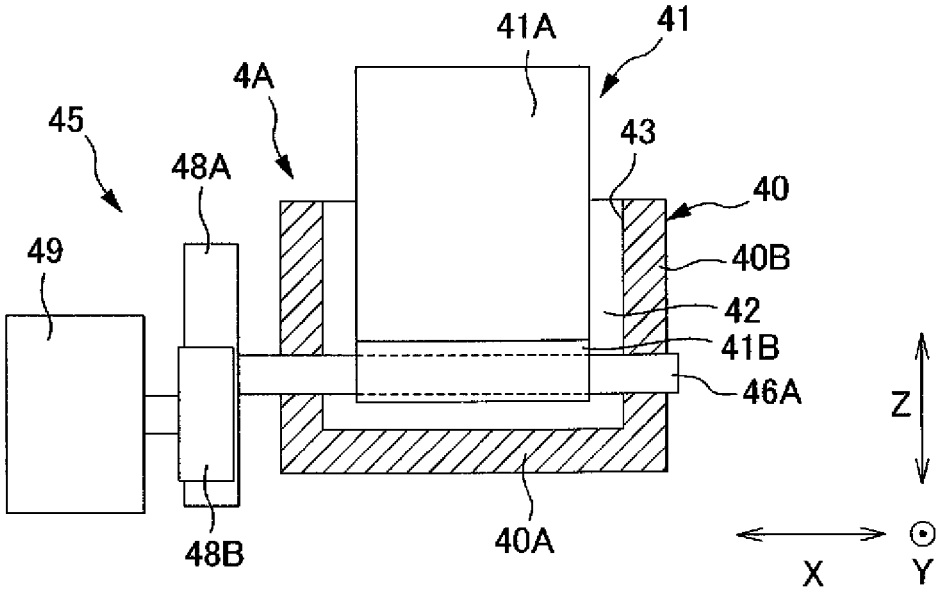
FIG. 16C is a vertical cross-sectional view in which the cleaning unit 4A in the second embodiment is viewed in the second direction Y2.

Next, a second embodiment is described with reference to FIGS. 15 to 16C. FIG. 15 is a vertical cross-sectional view showing a state in which a wiper opening 43 of a cleaning unit 4A in the second embodiment is shut by way of a wiper cap member 6A. FIG. 16A is a vertical cross-sectional view in which the wiper cap member 6A in the second embodiment is viewed in a conveying direction X. FIG. 16B is a vertical cross-sectional view in which the cleaning unit 4A in the second embodiment is viewed in the conveying direction X. FIG. 16C is a vertical cross-sectional view in which the cleaning unit 4A in the second embodiment is viewed in a second direction Y2.

As shown in FIGS. 15, 16B and 16C, the cleaning unit 4A in the second embodiment includes a wiper case 40, a wiper member 41, an axle member 46A, and a wiper pivoting drive mechanism 45.

The wiper case 40 is different from the first embodiment in that a stopper part 40S is not provided and other items are the same as those in the first embodiment.

Similarly to the first embodiment, the wiper member 41 has a wiping portion 41A and a support member 41B that supports the wiping portion 41A.

The axle member 46A penetrates through the support member 41B, and is pivotally supported by the wiper case 40. One end of the axle member 46A protrudes out from an external surface of the wiper case 40.

As shown in FIGS. 16B and 16C, the wiper pivoting drive mechanism 45 includes a major diameter gear 48A, a minor diameter gear 48B, and a drive motor 49. The major diameter gear 48A is attached to a portion protruding out from the external surface of the wiper case 40 in the axle member 46A. The minor diameter gear 48B is engaged with the major diameter gear 48A. The drive motor 49 has a rotational axis to which the minor diameter gear 48B is attached.

The wiper member 41 is pivoted about the axle member 46A in a forward direction and a backward direction by the wiper pivoting drive mechanism 45. As a result, the wiper member 41 is configured to be switchable between two states: the wiper member 41 being accommodated in a wiper accommodating portion 42 and standing erect while protruding out of the wiper accommodating portion 42 via the wiper opening 43. Other configurations are similar to those in the first embodiment.

It should be noted that a pivoting angle of the wiper member 41 is adjustable by changing a pivoting drive amount performed by the wiper pivoting drive mechanism 45.

As shown in FIGS. 15 and 16A, the wiper cap member 6A in the second embodiment includes an inner portion 61 and a flange 62. The inner portion 61 fits into the wiper accommodating portion 42 of the wiper case 40 to shut the wiper opening 43. The flange 62 abuts a top surface 40E of a side wall 40B of the wiper case 40 when the inner portion 61 fits into the wiper accommodating portion 42.

The wiper cap member 6A is different from the first embodiment in that a protrusion portion 64 having a depression slope 63 is not provided. Other configurations are similar to those in the first embodiment.

As described above, in the second embodiment, the wiper pivoting drive mechanism 45 is provided, which switches the wiper member 41 between the state of being accommodated in the wiper accommodating portion 42 and the state of standing erect for cleaning while protruding out of the wiper accommodating portion 42. Accordingly, if abrasion or deformation occurs to the wiping portion 41A of the wiper member 41 due to repetitive use of the wiper member 41, for example, it is possible to adjust the pivoting angle of the wiper member 41 driven by the wiper pivoting drive mechanism 45 such that a tip of the wiping portion 41A comes into contact with a nozzle face 31 of a recording head 30 elastically with a proper amount of force. Therefore, even if the wiper member 41 has been used repeatedly, cleaning can be appropriately performed.

Moreover, in the second embodiment, the adjustment of the pivoting angle of the wiper member 41 is arbitrarily changeable by the wiper pivoting drive mechanism 45 during the cleaning. For example, it is possible to adjust the wiper member 41 in the following manner: Among nozzle faces 31, the wiper member 41 does not contact the nozzle faces 31 in the area in which ink-injecting nozzles are not disposed, while the wiper member 41 contacts the nozzle faces 31 in the area in which the ink-injecting nozzles are disposed. This can suppress abrasion of the wiping portion 41A to a minimal level.

The exemplary embodiments of the present invention have been described above; however, the present invention is not limited thereto and can be carried out in various modes.

For example, in each embodiment described above, the wiper cap member 6 is moved mechanically and automatically between the standby position P6 and the shutting position P5 via the second lifting and lowering mechanism; however, it is not limited thereto. For example, the wiper cap member 6 may be opened and closed for the wiper case 40 by way of manual operation.

In addition, in each embodiment described above, the cleaning unit 4 and the cap unit 5 are disposed on the respective sides in the lateral direction Y so as to interpose the conveying unit 2 and the nozzle unit 3. In addition, the cleaning unit 4 and the cap unit 5 are moved independently of each other by the first horizontal movement mechanism and the second horizontal movement mechanism, respectively. However, the present invention is not limited to the exemplary embodiment. For example, the cleaning unit 4 and the cap unit 5 may be configured to be an integral unit, which is disposed on one side of the conveying unit 2 and the nozzle unit 3 in the lateral direction Y. And the integral unit of the cleaning unit 4 and the cap unit 5 may be configured to be moved by a single horizontal movement mechanism.

Furthermore, although the cap unit 5 is provided in each embodiment described above, the cap unit 5 is not essential in the present invention.

Moreover, in each embodiment described above, the conveying surface 22A and the nozzle face 31 of the recording head 30 can relatively approach and depart away from each other by moving the conveying unit 2 in relation to the nozzle unit 3; however, it is not limited thereto. For example, the nozzle face 31 of the recording head 30 and the conveying surface 22A may be configured to relatively approach and depart away from each other by moving the nozzle unit 3 without moving the conveying unit 2. In addition, the conveying surface 22A and the nozzle face 31 of the recording head 30 may be configured to relatively approach and depart away from each other by moving both of the conveying unit 2 and the nozzle unit 3.

Furthermore, although an explanation has been omitted in each embodiment described above, it may be preferable to use a control unit such as a computer in the inkjet recording device of the present invention. For example, the control unit may include a memory storing a control program that automatically performs an entire sequence of operation of recording an image and the like, cleaning the nozzle faces 31, and capping the nozzle faces 31 in a preset order.

Moreover, it may be possible to configure the present invention such that the wiper cap member 6 is disposed firmly and the wiper case 40 of the cleaning unit 4 is movable in the vertical direction Z to a cleaning unit base member 44 by way of a driving force such as a motor. With such a configuration, after completing the cleaning, the wiper case 40 can be moved upward in the vertical direction Z by the driving force such as a motor, thereby causing the wiper case 40 to abut the wiper cap member 6 (the wiper opening 43 of the wiper case 40 can be shut by the wiper cap member 6).

What is claimed is:

1. An inkjet recording device, comprising:

a recording head comprising a nozzle face on which an ink-inject nozzle is formed;

a cleaning unit comprising a wiper case and a wiper, the wiper case having a wiper accommodation portion and a wiper opening, the wiper configured to be accommodated in the wiper accommodation portion, protrude out of the wiper accommodation portion via the wiper opening and move relatively to the recording head to clean the recording head; and a wiper cap shutting the wiper opening of the wiper case, wherein the wiper cap is configured to move upward and downward in a vertical direction with respect to the wiper case, wherein the wiper cap shuts the wiper opening while the cleaning unit is not cleaning the recording head, wherein the cleaning unit includes a bias member that biases the wiper to pivot toward the wiper opening, wherein the wiper cap includes a protrusion portion attached to a bottom of the wiper cap and a depression slope is located on the protrusion portion, wherein the depression slope slants toward a plane orthogonal to a direction associated with the wiper cap approaching the wiper opening and depresses the wiper while the wiper cap is shutting the wiper opening, wherein the wiper is configured to come into contact with and be movable with respect to the depression slope, and wherein the wiper is configured to pivot in a direction away from the wiper opening in opposition to a force applied by the bias member while the wiper is depressed by the depression slope of the wiper cap, when the wiper cap is shutting the wiper opening.

2. The inkjet recording device according to claim 1, wherein the cleaning unit comprises:

an axle that is connected to the wiper and pivotally supported by the wiper case, one end of the axle protruding out from an external surface of the wiper case; and wherein the axle is configured to receive a driving force to its one end so as to pivot the wiper in a forward direction and a backward direction.

3. The inkjet recording device according to claim 2, wherein the wiper is configured to be switchable between a state of being accommodated in the wiper accommodation portion and a state of standing erect to protrude out of the wiper accommodation portion via the wiper opening, while driven by the axle, so as to pivot the wiper in the forward direction and the backward direction.

4. The inkjet recording device according to claim 1, wherein the cleaning unit comprises:

an axle that is connected to the wiper and pivotally supported by the wiper case, one end of the axle protruding out from an external surface of the wiper case; and wherein the axle is configured to receive a driving force to its one end so as to pivot the wiper in a forward direction and a backward direction.

5. The inkjet recording device according to claim 4, wherein the wiper is configured to be switchable between a state of being accommodated in the wiper accommodation portion and a state of standing erect to protrude out of the wiper accommodation portion via the wiper opening, while driven by the axle so as to pivot the wiper in the forward direction and the backward direction.

6. The inkjet recording device according to claim 1, further comprising:

a conveying unit that faces the nozzle face of the recording head and has a conveying surface that can relatively approach and depart away from the nozzle face, the conveying unit conveying a recording medium positioned on the conveying surface; and a nozzle cap covering the nozzle face of the recording head, wherein the cleaning unit is configured to be movable in a first direction in a separated state in which the conveying surface is apart from the nozzle face and disposed in a conveying space between the nozzle face and the conveying surface, and wherein the nozzle cap is configured to be movable in a second direction opposite to the first direction towards the conveying surface in the separated state and disposed in the conveying space.

7. The inkjet recording device according to claim 1, wherein the bias member comprises a spring.

8. The inkjet recording device according to claim 1, wherein the depression slope depresses the wiper after the depression slope comes into contact with the wiper while the wiper cap is shutting the wiper opening.

* * * * *